US012385478B2

(12) United States Patent
Gim

(10) Patent No.: US 12,385,478 B2
(45) Date of Patent: Aug. 12, 2025

(54) SYSTEM AND METHOD OF STARTING AIR COMPRESSOR IN LOW-TEMPERATURE STATE

(71) Applicants: Hyundai Motor Company, Seoul (KR); Kia Corporation, Seoul (KR)

(72) Inventor: Hyeong U Gim, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 525 days.

(21) Appl. No.: 17/479,498

(22) Filed: Sep. 20, 2021

(65) Prior Publication Data

US 2022/0220954 A1 Jul. 14, 2022

(30) Foreign Application Priority Data

Jan. 8, 2021 (KR) ..... 10-2021-0002557

(51) Int. Cl.
*F04B 39/02* (2006.01)
*F04B 49/03* (2006.01)
*F04B 49/22* (2006.01)

(52) U.S. Cl.
CPC ..... *F04B 39/0276* (2013.01); *F04B 49/03* (2013.01); *F04B 49/22* (2013.01)

(58) Field of Classification Search
CPC .... F04C 14/24; F04C 14/26; F04C 2270/195; F04B 27/109; F04B 2203/0205; F04B 39/0207; F04B 49/24; F04B 29/03; F04B 39/0276; F04B 53/18; F04B 2201/0402
USPC ..... 417/281; 184/6.22
See application file for complete search history.

(56) References Cited

U.S. PATENT DOCUMENTS 4,050,852 A * 9/1977 Brucken ..... F04B 27/18 417/221
4,971,532 A * 11/1990 Slattery ..... F04B 7/06 184/33

FOREIGN PATENT DOCUMENTS

JP 2013198378 A * 9/2013
KR 2019-0035104 A 4/2019
KR 2020-0041061 A 4/2020

* cited by examiner

*Primary Examiner* — Philip E Stimpert
(74) *Attorney, Agent, or Firm* — Fox Rothschild LLP

(57) ABSTRACT

A system for starting an air compressor in a low-temperature state includes a motor configured to generate rotation force according to a control signal of a controller, a piston configured to compress air through reciprocating motion using rotation force of the motor, an oil pump configured to provide oil stored in an oil pan to a rotation axis of the motor, an oil supply line configured to connect the oil pan to the oil pump, a recovery line configured to connect a discharge port of the oil pump to the oil supply line, and a valve connected to the recovery line and controlled by the controller, where the controller controls an on/off state of the valve based on a temperature of the motor, revolutions per minute (RPM) of the motor, or a pressure of the oil pump.

10 Claims, 5 Drawing Sheets

SYSTEM AND METHOD OF STARTING AIR COMPRESSOR IN LOW-TEMPERATURE STATE

CROSS-REFERENCE TO RELATED APPLICATION

This application claims under 35 U.S.C. § 119(a) the benefit of Korean Patent Application No. 10-2021-0002557 filed on Jan. 8, 2021, the entire contents of which are incorporated herein by reference.

BACKGROUND

(a) Technical Field

The present disclosure relates to a system and method of starting an air compressor in a low-temperature state for reducing an initial load of a motor in the low-temperature state.

(b) Description of the Related Art

An electric air compressor for generating compressed air for braking is applied to a commercial electric vehicle (EV) or a commercial fuel cell electric vehicle (FCEV). The electric air compressor is classified into a reciprocating-type air compressor, a screw type air compressor, and a scroll type air compressor depending on an operation method, and the reciprocating-type air compressor typically is applied to a commercial vehicle that requires high durability.

An oil pump is applied to the reciprocating-type air compressor, and thus a lubricant is applied to a friction area at which a piston and a crank shaft contact each other. In this case, components for lubrication include an oil pan, a suction pipe, an oil pump (an external or internal gear pump), and a relief valve, and the same components are included in a reciprocating-type electric air compressor of a commercial vehicle.

However, as an initial load applied to a motor becomes excessive when the motor is initially operated, a controller is not capable of ensuring a gain value for controlling the motor, and thus there is a problem in that the responsiveness of the motor is degraded. There is a problem in that, as the responsiveness of the motor is degraded, a long time is required until an air compressor is normally operated, and noise is generated due to an excessive initial load when the air compressor is initially operated.

SUMMARY

The present disclosure provides a system and method of starting an air compressor in a low-temperature state for controlling an on/off state of a solenoid valve in order to an initial load of a motor in a low-temperature state.

An embodiment of the present disclosure provides a system for starting an air compressor in a low-temperature state. The system for starting an air compressor in a low-temperature state includes a motor configured to generate rotation force according to a control signal of a controller, a piston configured to compress air through reciprocating motion using rotation force of the motor, an oil pump configured to provide oil stored in an oil pan to a rotation axis of the motor, an oil supply line configured to connect the oil pan to the oil pump, a recovery line configured to connect a discharge port of the oil pump to the oil supply line, and a valve connected to the recovery line and controlled by the controller, wherein the controller controls an on/off state of the valve based on a temperature of the motor, revolutions per minute (RPM) of the motor, or a pressure of the oil pump.

For example, when the motor is initially driven, if the temperature of the motor is less than or equal to a preset temperature, the controller may open the valve between the discharge port of the oil pump and a suction port of the oil pump.

For example, the preset temperature may a subzero temperature at which viscosity of the oil increases.

For example, when the motor is driven, a pressure between the discharge port and the suction port may become in an equilibrium state, the oil pump may be rotated in a no-load state, and the oil may not flow even if the oil pump is operated.

For example, when the revolutions per minute (RPM) of the motor reach preset target revolutions per minute (RPM), the controller may close the valve, and as the valve is closed, pressure equilibrium between the suction port and the discharge port may be broken, and the oil pump may supply the oil stored in the oil pan to the rotation axis.

For example, when the motor is initially driven, if a temperature of the motor is greater than a preset temperature, the controller may maintain the valve between the discharge port of the oil pump and a suction port of the oil pump in a closed state.

For example, when the pressure of the oil pump reaches a preset maximum pressure after the motor and the oil pump are operated, the controller may maintain the pressure of the oil pump to be the preset maximum pressure or less by opening the valve.

For example, the controller may set the preset maximum pressure to be less and may increase efficiency of the motor.

For example, the rotation axis may connect the motor, the piston, and the oil pump, and an oil path in which oil flows may be defined in the rotation axis.

An embodiment of the present disclosure provides a method of starting an air compressor in a low-temperature state. The method of starting an air compressor in a low-temperature state includes monitoring, by a controller, whether a temperature of a motor for driving the air compressor is less than or equal to a preset temperature, comparing, by the controller, the temperature of the motor with the preset temperature and controlling a valve on a line for connecting a suction port to a discharge port of an oil pump driven by rotation force generated by the motor, and opening, by the controller, the valve when the pressure of the oil pump reaches a preset maximum pressure through operations of the motor and the oil pump.

For example, the comparing, by the controller, the temperature of the motor with the preset temperature and controlling the valve may include opening the valve when the temperature of the motor is less than or equal to the preset temperature, and maintaining the valve in a closed state when the temperature of the motor is greater than the preset temperature.

For example, when the valve is open, the discharge port and the suction port of the oil pump may be connected to each other, a pressure on the line may become in an equilibrium state, and the oil pump is rotated in a no-load state by rotation force of the motor.

For example, when revolutions per minute (RPM) of the motor reach preset revolutions per minute (RPM) after the valve is open, the controller may close the valve to allow the oil pump to provide oil to a rotation axis of the motor.

For example, after the valve is open, the controller may perform air purge of the air compressor and turning off of the motor.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

DETAILED DESCRIPTION

Figure 1:
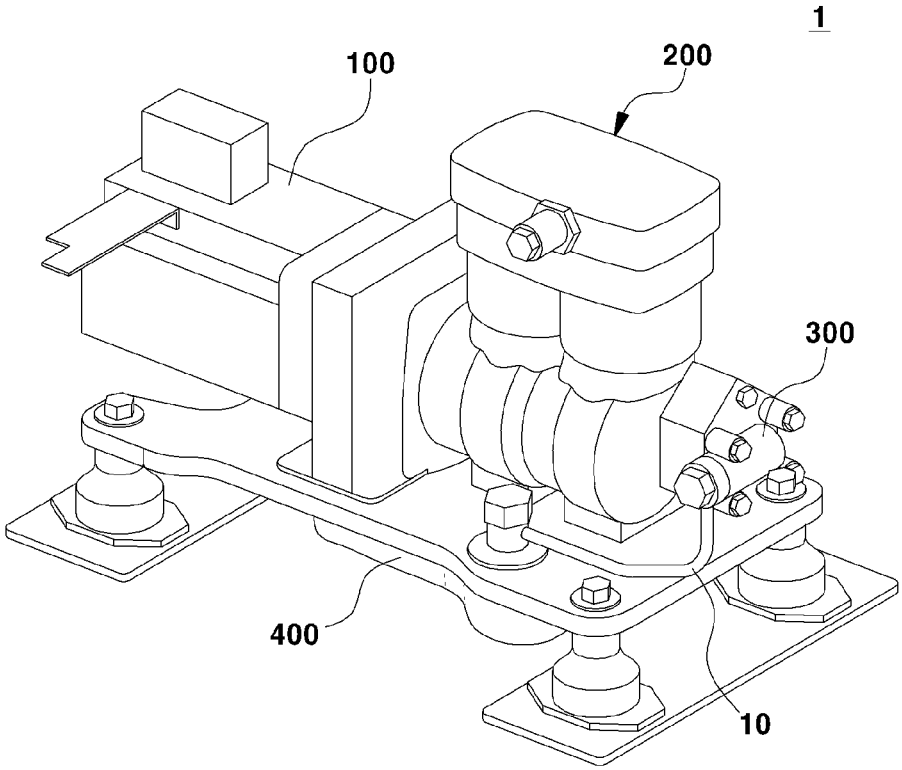
FIG. 1 is a diagram showing an air compressor according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

The attached drawings for illustrating exemplary embodiments of the present disclosure are to be referred to in order to gain a sufficient understanding of the present disclosure, the merits thereof, and the objectives accomplished by the implementation of the present disclosure. The present disclosure may, however, be embodied in many different forms, and should not be construed as being limited to the embodiments set forth herein; rather, these embodiments are provided so that this disclosure will be thorough and complete, and will fully convey the concept of the present disclosure to one of ordinary skill in the art. Meanwhile, the terminology used herein is for the purpose of describing particular embodiments and is not intended to limit the present disclosure. Like reference numerals in the drawings denote like elements.

The detailed description is used to exemplify the present disclosure. The description herein is given to show exemplary embodiments of the present disclosure, and the present disclosure may be used in various other combinations, changes, and environments. That is, the present disclosure may be changed or modified within the scope of the concept of the present disclosure disclosed in the specification, the equivalent scope of the given disclosure, and/or the scope of the technology or knowledge in the art. The described embodiment is the ideal embodiment for implementing the technological spirit of the present disclosure, but may be changed in various forms required in detailed applications and use of the present disclosure. Thus, the detailed description of the present disclosure herein is merely exemplary, and is not intended to limit the present disclosure. The following claims are to be interpreted as including other embodiments.

Figure 2:
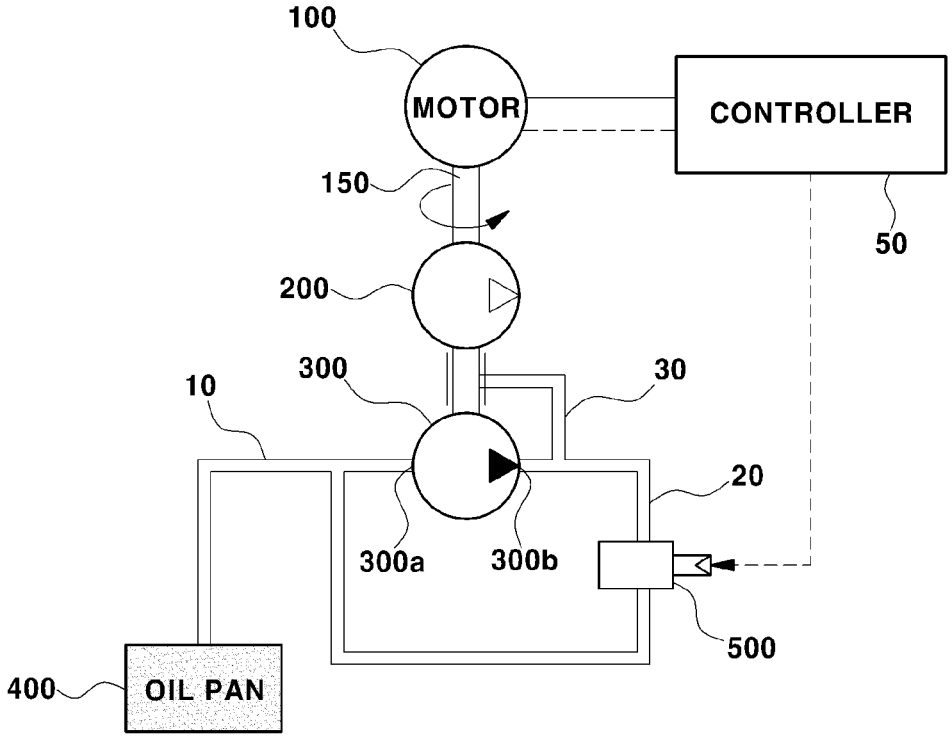
FIG. 2 is a diagram showing an example of an operation of a system for starting an air compressor in a low-temperature state according to the present disclosure.

FIG. 1 is a diagram showing an air compressor according to an embodiment of the present disclosure. FIG. 2 is a diagram showing an example of an operation of a system for starting an air compressor in a low-temperature state according to the present disclosure.

Referring to FIGS. 1 and 2, an air compressor 1 may include a motor 100, a piston 200, an oil pump 300, and an oil pan 400. The air compressor 1 may be controlled by a controller 50. The controller 50 optionally may include an inverter (not shown) for controlling the motor 100. The air compressor 1 according to an embodiment of the present disclosure may be applied to a commercial electric vehicle (EV) or a commercial fuel cell electric vehicle (FCEV).

The motor 100 may be disposed at one side of the air compressor 1 and may generate rotation force. The rotation force generated by the motor 100 may be transferred to a rotation axis 150. The motor 100 may be controlled according to a control signal received from the controller 50.

The piston 200 may compress air through reciprocating motion using the rotation force of the motor 100. The air compressed by the piston 200 may be provided to a pneumatic brake (not shown) or an air suspension (not shown) of the commercial vehicle. An eccentricity unit (not shown) for converting rotational motion of the rotation axis 150 into reciprocating motion may be provided in the air compressor 1, and the piston 200 may reciprocate through the eccentricity unit (not shown).

The oil pump 300 may provide oil stored in the oil pan 400 to the rotation axis 150. The oil pump 300 may include an external or internal gear pump and may be rotated by rotation force of the rotation axis 150. The oil pump 300 may include a suction port 300*a* to which oil is introduced from the oil pan 400 and a discharge port 300*b* from which oil is discharged. The oil pump 300 may be disposed at the other side of the air compressor 1. That is, the oil pump 300 and the motor 100 may be disposed to face each other based on the piston 200. The rotation axis 150 may connect the motor 100 to the oil pump 300.

An oil supply line 10 may connect the oil pan 400 to the oil pump 300. That is, oil stored in the oil pan 400 may flow to the oil pump 300 along the oil supply line 10 according to an operation of the oil pump 300. The oil supply line 10 may be connected to the suction port 300*a* of the oil pump 300. The oil supply line 10 may be disposed out of a housing that defines an outer shape of the air compressor 1.

Oil discharged through the discharge port 300*b* of the oil pump 300 may flow to a recovery line 20 and a discharge line 30. The recovery line 20 may connect the discharge port 300*b* of the oil pump 300 to the oil supply line 10. The discharge line 30 may supply oil to the rotation axis 150. The discharge line 30 may be a line branched from the recovery line 20.

A valve 500 may be installed on the recovery line 20. The valve 500 may control opening and closing of the recovery line 20. For example, the valve 500 may be a solenoid valve that is turned on/off according to a control signal of the controller 50.

The controller 50 may control the motor 100 and the valve 500. The controller 50 may control an on/off state of the motor 100 and revolutions per minute (RPM) of the motor 100. The controller 50 may monitor the temperature of the motor 100, the revolutions per minute (RPM) of the motor 100, and the pressure of the oil pump 300. The controller 50 may control an on/off state of the valve 500 based on the temperature of the motor 100, the revolutions per minute (RPM) of the motor 100, and the pressure of the oil pump 300.

For example, when a motor 10 is initially driven, if the temperature of the motor 100 is less than or equal to a preset temperature, the controller 50 may open the valve 500 between the discharge port 300*b* of the oil pump 300 and the suction port 300*a* of the oil pump 300. As the motor 100 is driven and the valve 500 is open, the pressure between the discharge port 300*b* and the suction port 300*a* may become in an equilibrium state, and the oil pump 300 may be rotated in a no-load state. That is, the oil pump 300 may be rotated but may not pull up oil. In other words, oil may not flow even if the oil pump 300 is operated. The preset temperature may be a subzero temperature at which the viscosity of oil increases. For example, the preset temperature may be −25° C.

When the discharge port 300*b* and the suction port 300*a* of the oil pump 300 are connected to each other, even if the motor 100 begins to be driven and the oil pump 300 is operated, a flow ratio of the discharge port 300*b* may be returned to the suction port 300*a* in which a low pressure is formed, and thus a vacuum pressure may not be formed and the pressure may be equilibrated. Accordingly, the oil pump 300 may be operated in a no-load state and oil may not be supplied to the rotation axis 150, but the rotation axis 150 and a portion at which the rotation axis 150 and the piston 200 contact each other may be lubricated by oil that remains in an oil path defined in the rotation axis 150.

According to an embodiment of the present disclosure, when the air compressor 1 is a low-temperature state, the viscosity of oil may be increased and an initial load of the motor 100 may become excessive. Accordingly, a large amount of time taken to reach the target revolutions per minute (RPM) required by the motor 100 may be consumed, and the responsiveness of the motor 100 may be lowered. Thus, the controller 50 may reduce an initial load applied to the motor 100 by opening the valve 500 to rotate the oil pump 300 in a no-load state when the motor 100 is initially driven in a low-temperature state.

Figure 3:
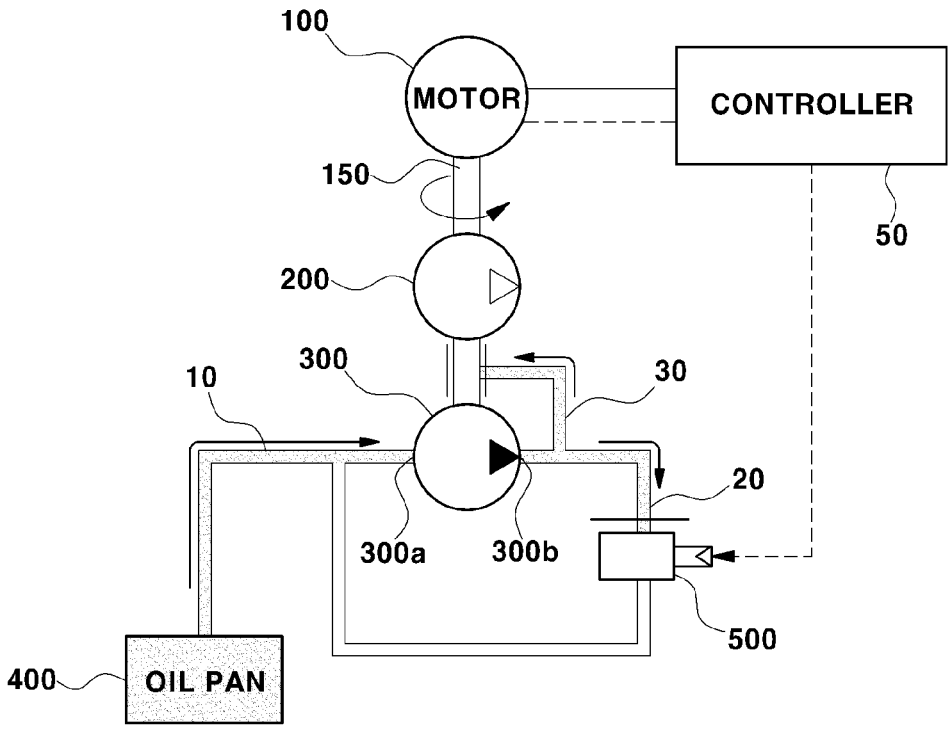
FIG. 3 is a diagram showing another example of an operation of a system for starting an air compressor in a low-temperature state according to the present disclosure.

FIG. 3 is a diagram showing another example of an operation of a system for starting an air compressor in a low-temperature state according to the present disclosure. For the sake of brevity, descriptions of FIG. 3 that are similar to those described with respect to FIG. 2 will be omitted.

Referring to FIG. 3, after the motor 100 and the oil pump 300 are operated, the revolutions per minute (RPM) of the motor 100 may reach preset target revolutions per minute (RPM). When the revolutions per minute (RPM) of the motor 100 reach the preset target revolutions per minute (RPM), the controller 50 may close the valve 500. As the valve 500 is closed, pressure equilibrium between the suction port 300*a* and the discharge port 300*b* may be broken, and thus the oil pump 300 may supply oil stored in the oil pan 400 to the rotation axis 150. Oil may flow to the rotation axis 150 through the discharge line 30. Flow of the oil that flows to the recovery line 20 may be blocked by the valve 500.

That is, when the motor 100 is initially driven, if the temperature of the motor 100 is greater than a preset temperature, the controller 50 may maintain the state in which the valve 500 between the discharge port 300*b* of the oil pump 300 and the suction port 300*a* of the oil pump 300 is closed. In this case, when the temperature of the motor 100 is greater than a preset temperature, the viscosity of oil may not be increased, and an initial load applied to the motor 100 may not be increased. Thus, the controller 50 may determine that no-load rotation of the oil pump 300 is not required and may not open the valve 500.

For example, the rotation axis 150 may be lubricated through oil that remains on the rotation axis 150 for connecting the motor 100 to the oil pump 300 until the revolutions per minute (RPM) of the motor 100 reach preset target revolutions per minute (RPM).

For example, when the revolutions per minute (RPM) of the motor 100 reach the preset target revolutions per minute (RPM), the oil pump 300 may provide oil stored in the oil pan 400 to the rotation axis 150 by closing the valve 500.

Figure 4:
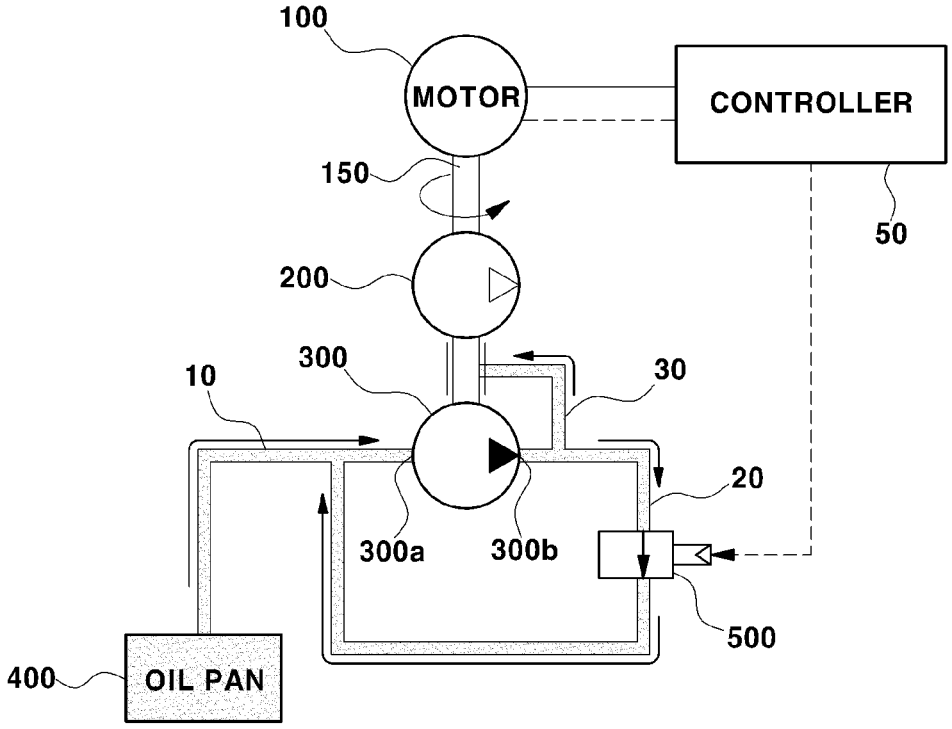
FIG. 4 is a diagram showing another example of an operation of a system for starting an air compressor in a low-temperature state according to the present disclosure.

FIG. 4 is a diagram showing another example of an operation of a system for starting an air compressor in a low-temperature state according to the present disclosure. For the sake of brevity, descriptions of FIG. 4 similar to those already described with respect to FIG. 2 or 3 will be omitted.

Referring to FIG. 4, after the motor 100 and the oil pump 300 are operated, the pressure of the oil pump 300 may reach a preset maximum pressure. When the pressure of the oil pump 300 reaches the preset maximum pressure, the controller 50 may open the valve 500 to maintain of the oil pump 300 in the preset maximum pressure or less. The suction port 300*a* and the discharge port 300*b* of the oil pump 300 may be connected to each other by opening the valve 500.

Oil may flow to the rotation axis 150 through the discharge line 30, and oil that flows to the recovery line 20 may flow to the oil supply line 10. As oil flows through the recovery line 20, the pressure of the oil pump 300 may not be increased any further.

The controller 50 may change the preset maximum pressure. When the preset maximum pressure is set to be low, the efficiency of the motor 100 or the efficiency of the air compressor may be increased. The controller 50 may set a maximum pressure appropriate for a vehicle in which the air compressor is installed.

Figure 5:
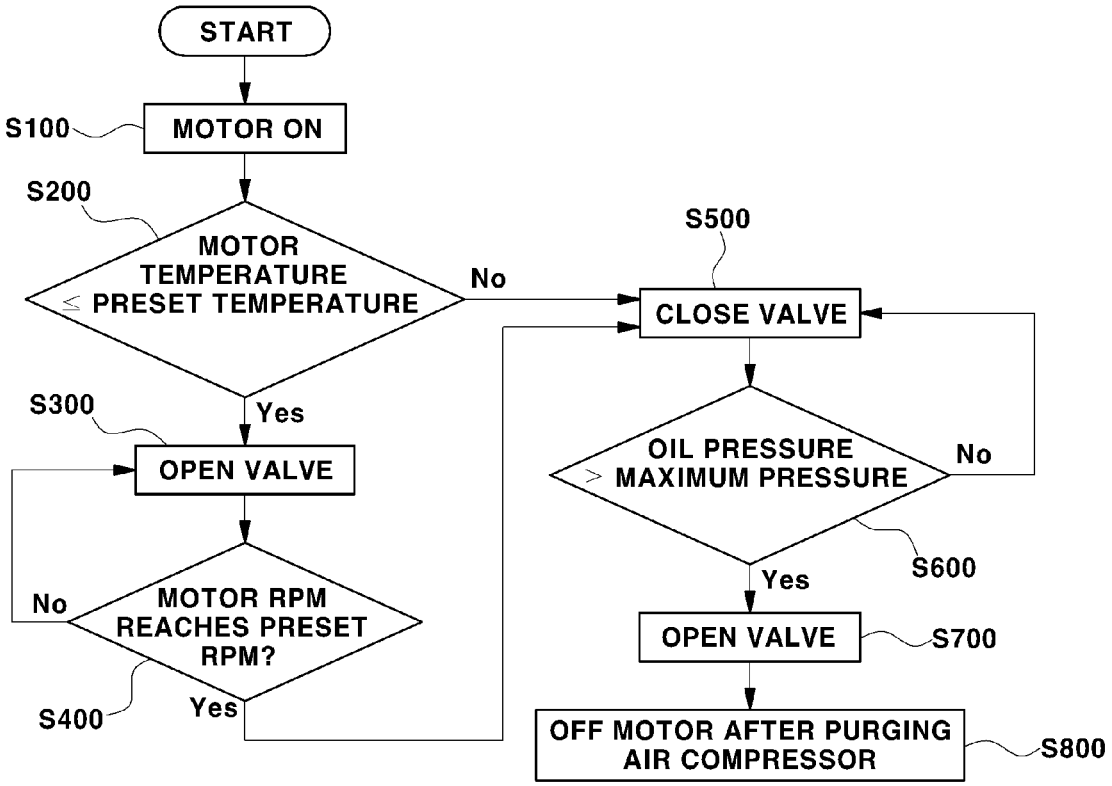
FIG. 5 is a flowchart showing a driving method when an air compressor is in a low-temperature state according to an embodiment of the present disclosure.

FIG. 5 is a flowchart showing a driving method when an air compressor is in a low-temperature state according to an embodiment of the present disclosure.

Referring to FIG. 5, when a motor is initially driven, a controller may monitor the temperature of the motor for driving the air compressor (S100).

The controller may compare the temperature of the motor with a preset temperature. When the temperature of the motor is less than or equal to the preset temperature, the controller may open a valve disposed on a line that connects a suction port and a discharge port of an oil pump driven by rotation force generated by the motor. As the valve is open, the discharge port and the suction port of the oil pump may be connected to each other, and thus the pressure on the recovery line may be an equilibrium state. Accordingly, the oil pump may be rotated in a no-load state by the rotation force of the motor, and oil may not flow. However, when the temperature of the motor is greater than a preset temperature, the valve may be maintained in a closed state. When the motor is driven in the state in which the valve is closed, the oil pump may not be rotated in a no-load state to prevent oil from flowing until the revolutions per minute (RPM) of the motor reach the target revolutions per minute (RPM) (S200, S300, and S500).

When the temperature of the motor is less than or equal to the preset temperature and the valve is open, the controller may monitor whether the revolutions per minute (RPM) of the motor reach the target revolutions per minute (RPM). The oil pump may be rotated in a no-load state until the revolutions per minute (RPM) of the motor reach the target revolutions per minute (RPM) (S400).

When the revolutions per minute (RPM) of the motor reach the target revolutions per minute (RPM), the controller may close the valve. As the valve is closed, pressure equilibrium between the suction port and the discharge port may be broken. Accordingly, oil may flow toward the oil pump according to the pressure of the suction port of the oil pump, and the oil pump may supply oil to the rotation axis (S500).

When the pressure of the oil pump reaches a preset maximum pressure through operations of the motor and the oil pump, the controller may open the valve. When the pressure of the oil pump reaches the maximum pressure, it may not be required to compress air to be supplied to the pneumatic brake or the air suspension installed in the vehicle any longer. Thus, the controller may open the valve and may maintain the pressure of the oil pump in the maximum pressure or less (S600).

After the pressure of the oil pump reaches the maximum pressure, the air compressor may purge air. After purging air, the air compressor may not need to compress air, and thus the motor may be turned off. The air compressor may be driven again when there is a need to compress air again (S700).

According to an embodiment of the present disclosure, the controller may reduce an initial load applied to the motor by opening the valve to rotate the oil pump in a no-load state when the motor is initially driven in a low-temperature state.

According to an embodiment of the present disclosure, the controller may set the maximum pressure of the oil pump according to a vehicle, thereby improving the efficiency of the air compressor.

The present disclosure has been described in detail with reference to preferred embodiments thereof. However, it will be appreciated by those skilled in the art that changes may be made in these embodiments without departing from the principles and spirit of the present disclosure, the scope of which is defined in the appended claims and their equivalents.

What is claimed is:

1. A system for starting an air compressor in a low-temperature state, the system comprising:

a motor configured to generate rotation force according to a control signal of a controller;

a piston configured to compress air through reciprocating motion using rotation force of the motor;

an oil pump configured to provide oil stored in an oil pan to a rotation axis of the motor;

an oil supply line configured to connect the oil pan to a suction port of the oil pump;

a recovery line configured to connect a discharge port of the oil pump to the oil supply line; and a valve connected to the recovery line and controlled by the controller, wherein the controller controls an on/off state of the valve based on a temperature of the motor, revolutions per minute (RPM) of the motor, and a pressure of the oil pump, wherein oil discharged through the discharge port of the oil pump flows to the recovery line and a discharge line, wherein the discharge line supplies oil to the rotation axis;

wherein, when the motor is initially driven, if the temperature of the motor is less than or equal to a preset temperature, the controller opens the valve between the discharge port of the oil pump and the suction port of the oil pump such that a pressure between the discharge port and the suction port reaches an equilibrium state, the oil pump is rotated in a no-load state, and the oil does not flow even if the oil pump is operated.

2. The system of claim 1, wherein the preset temperature is less than 0 degrees Celsius, which is a temperature at which viscosity of the oil increases.

3. The system of claim 1, wherein when the revolutions per minute (RPM) of the motor reach preset target revolutions per minute (RPM), the controller closes the valve, and as the valve is closed, pressure equilibrium between the suction port and the discharge port is broken, and the oil pump supplies the oil stored in the oil pan to the rotation axis.

4. The system of claim 1, wherein when the motor is initially driven, if the temperature of the motor is greater than the preset temperature, the controller maintains the valve between the discharge port of the oil pump and the suction port of the oil pump in a closed state.

5. The system of claim 1, wherein when the pressure of the oil pump reaches a preset maximum pressure after the motor and the oil pump are operated, the controller maintains the pressure of the oil pump to be the preset maximum pressure or less by opening the valve.

6. The system of claim 5, wherein the controller sets the preset maximum pressure to be less and increases efficiency of the motor.

7. The system of claim 1, wherein:

the rotation axis connects the motor, the piston, and the oil pump; and an oil path in which oil flows is defined in the rotation axis.

8. A method of starting an air compressor in a low-temperature state, the method comprising:

monitoring, by a controller, whether a temperature of a motor for driving the air compressor is less than or equal to a preset temperature;

comparing, by the controller, the temperature of the motor with the preset temperature and controlling a valve on a recovery line for connecting a suction port to a discharge port of an oil pump driven by rotation force generated by the motor; and opening, by the controller, the valve when a pressure of the oil pump reaches a preset maximum pressure through operations of the motor and the oil pump, wherein oil discharged through the discharge port of the oil pump flows to the recovery line and a discharge line and the discharge line supplies oil to the rotation axis;

wherein comparing the temperature of the motor with the preset temperature and controlling the valve comprises:

opening the valve when the temperature of the motor is less than or equal to the preset temperature; and maintaining the valve in a closed state when the temperature of the motor is greater than the preset temperature; and wherein, when the valve is open, the discharge port and the suction port of the oil pump are connected to each other, a pressure on the line reaches an equilibrium state, the oil pump is rotated in a no-load state by rotation force of the motor, and the oil does not flow even if the oil pump is operated.

9. The method of claim 8, wherein when revolutions per minute (RPM) of the motor reach preset revolutions per minute (RPM) after the valve is open, the controller closes the valve to allow the oil pump to provide oil to a rotation axis of the motor.

10. The method of claim 8, wherein after the valve is open, the controller performs air purge of the air compressor and turning off of the motor.

* * * * *